US006874912B2

(12) United States Patent
Hsu et al.

(10) Patent No.: US 6,874,912 B2
(45) Date of Patent: Apr. 5, 2005

(54) LIGHT CUTTER OF A LAMP FOR PROJECTOR

(75) Inventors: Nien-Hui Hsu, Hsinchu (TW); Sen-Ming Hsu, Hsinchu (TW)

(73) Assignee: Coretronic Corporation, Hsinchu (TW)

( * ) Notice: Subject to any disclaimer, the term of this patent is extended or adjusted under 35 U.S.C. 154(b) by 0 days.

(21) Appl. No.: 10/630,745

(22) Filed: Jul. 31, 2003

(65) Prior Publication Data

US 2004/0032737 A1 Feb. 19, 2004

(30) Foreign Application Priority Data

Aug. 16, 2002 (TW) ..... 91213023 U

(51) Int. Cl.[7] ..... F21V 29/00
(52) U.S. Cl. ..... 362/294; 362/373
(58) Field of Search ..... 362/294, 373, 362/264, 547; 352/202

(56) References Cited

U.S. PATENT DOCUMENTS 4,425,599 A * 1/1984 Rieder et al. ..... 362/552
5,099,399 A * 3/1992 Miller et al. ..... 362/580
5,479,322 A * 12/1995 Kacheria ..... 362/581
6,068,385 A * 5/2000 Hsieh ..... 362/188

* cited by examiner

*Primary Examiner*—Thomas M. Sember
(74) *Attorney, Agent, or Firm*—Bacon & Thomas PLLC

(57) ABSTRACT

A light cutter device. The device uses a fan to produce airflows flowing through a cylinder-like or core-like lamp reflector so as to form a wake region downstream of the lamp reflector. A front light cutter is placed on the wake region, and an upper light cutter and a lower light cutter are respectively installed at both sides of the lamp reflector. One end of the light cutters is mounted at a lamp housing by bolts, and the other end maintains a distance from the lamp reflector and extends to the back end of the lamp along the contour of the lamp reflector. The light cutters are able to shelter the bright light beam, emitting from the lamp, towards the outlet of airflows to not leak out of the projector and lead airflows to cool the lamp reflector. As a result, there is no need to install a decline guide on the airflows for sheltering the light so that the block o the airflow outlet decreases.

7 Claims, 4 Drawing Sheets

LIGHT CUTTER OF A LAMP FOR PROJECTOR

BACKGROUND OF THE INVENTION

1. Field of the Invention

The present invention relates to a projector, and more particularly to a light cutter of a lamp for projector.

2. Description of the Related Art

As the development of the technology, the projectors are used in various fields. With using the high power lamps and the images brightness rising, the cooling and light leaking of the projector is more important. Therefore, rising the cooling efficiency and light sheltering of the projector to raise the market competition is a challenge of the business.

Referring to FIG. 1 is a light lamp 10 of a projector and a ventilator guides 111 of the prior art. A generally light lamp 10 of the projector, which is formed with a glass lamp reflector 101 surrounded a filament 102. For the filament 102 can emit a high brightness light, which uses the high power light lamp 10 and electroplates or daub a high reflection surface within the inner surface of the glass lamp reflector 101 to reflect illuminating light from the filament 102. However, the part of the high brightness light emitting from the filament 102 still passes through the glass lamp reflector 101 toward all different directions. The whole light lamp 10 is placed within the projector, which is coved by the projector casing (not shown), so the illuminating light unlikely leaks out of the projector. For cooling the high power light lamp 10, the cooling fan 12 must cooperate with the ventilator 11 with an inclined guide 111 to shelter the illuminating light that passes through the lamp reflector 101 toward the ventilator 11 and prevent the illuminating light leaking. But the inclined guide 111 increases the wind resistance and disorders the airflows around the light lamp 10. The airflow can't be exhausted smoothly, lowering the cooling efficiency. Therefore, the projector of the prior art has no choice but to raise the rotational speed of the fan 12 for keeping the wanted cooling efficiency, which causes the noises and reduces the lifetime of the fan 12. In addition, the inclined guide 111 guides the hot air directly blowing toward the tabletop, raising the temperature of table, which causes the customer's concerns.

SUMMARY OF THE INVENTION

An object of the present invention is to provide a light cutter of a lamp for projector, which directly shelters the illuminating light toward a ventilator and prevents the light leaking to raise the quality of the images.

Another object of the present invention is to provide a light cutter of a lamp for projector, which can effectively shelter the radiation heat produced by the light lamp to lower the temperature of the projector casing.

Another object of the present invention is to provide a light cutter of a lamp for projector, which can reduce the wind resistance of the ventilator to raise the airflows and increase the cooling efficiency.

Another object of the present invention is to provide a light cutter of a lamp for projector, which can reduce the radiation heat loading of the projector, lower the working temperature and rotational speed of each component, rise the lifetime of the components, and lower the noises of the projector.

To achieve the above and other objects, the present invention uses a fan to produce airflows flowing through a cylinder-like or core-like lamp reflector so as to form a wake region on the downstream of the lamp reflector. A front light cutter is placed on the wake region, and an upper light cutter and a lower light cutter are respectively installed at the both side of lamp reflector. One end of these light cutters is mounted at a lamp housing by bolts, and the other end keeps a distance from the lamp reflector and extends to the back end of the lamp along the contour of the lamp reflector. Therefore, these light cutters are able to shelter the bright light beam, emitting from the lamp, toward the outlet of airflows not to leak out of the projector and lead airflows to cool the lamp reflector. As a result, there is no need to install a decline guide on airflows for sheltering the light so that the block of the airflow outlet decreases. In addition, the inclined guide 111 guides the hot air directly blowing toward the tabletop, raising the temperature of table, which causes the customer's concerns.

BRIEF DESCRIPTION OF THE DRAWINGS

The above and other objects, advantages, and features of the present invention will be understood from the following detailed description of the invention when considered in connection with the accompanying drawings below.

DETAILED DESCRIPTION OF THE INVENTION

Figure 1:
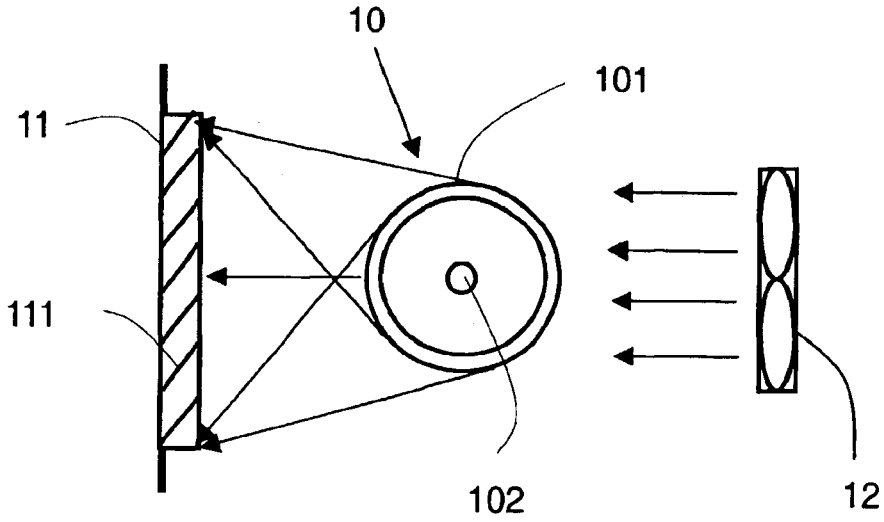
FIG. 1 (PRIOR ART)
FIG. 1 is schematic view showing the light lamp for projector and the ventilator of the prior art.
Figure 2:
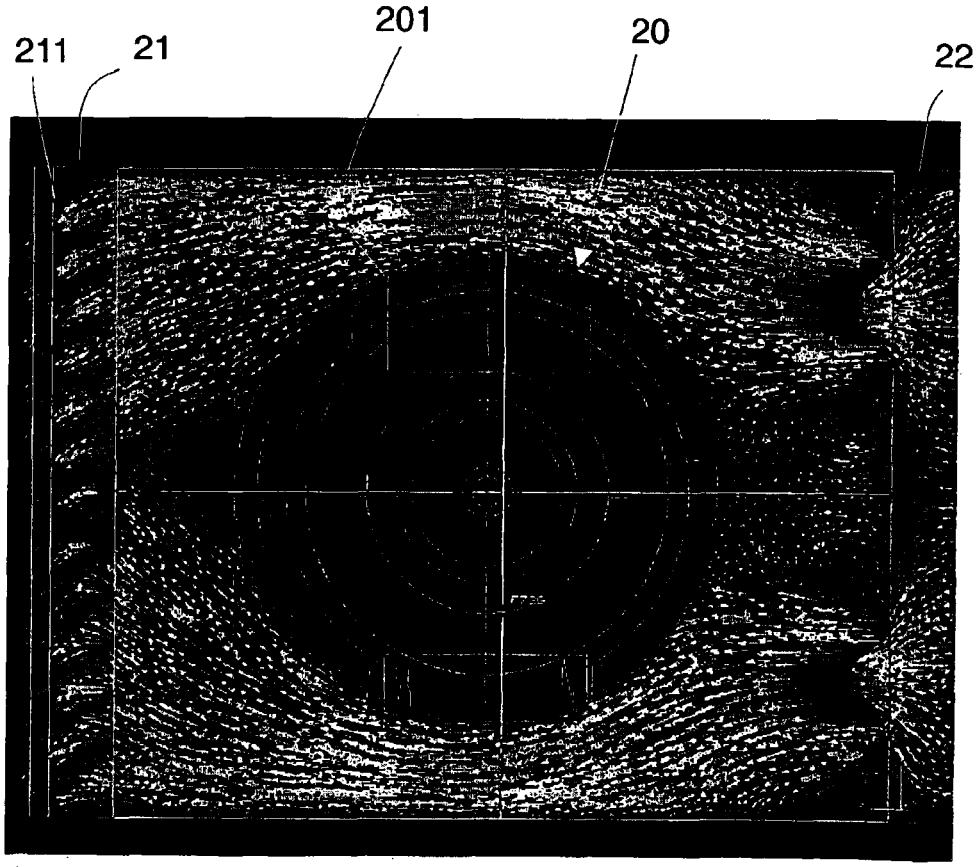
FIG. 2 (PRIOR ART)
FIG. 2 is a simulation experiment view showing the streamline of the light lamp for projector of the prior art.

Referring to the FIG. 2 is a simulation experiment view showing the streamline of a light lamp of the prior art. Adjacent to the one side of a light lamp 20 is a ventilator 21, the ventilator 21 having a guide 211, and the other side of the light lamp 20 is a cooling fan 22. A lamp reflector 201 of the light lamp 20 is cylinder-like or core-like. As the rotational speed rising to a certain loading, the air speeds distribution of the guide 211 outlets beside the light lamp 20, the upper and lower sides without shielding by the light lamp 201, maintain the highest speed 4.55 m/s. But closing to the central of the side surface of the light lamp 20, the air speeds gradually decrease to 0 m/s. According to the streamline of the air speeds distribution, it is apparent that the downstream of the light lamp 20 forms a wake region.

Figure 3:
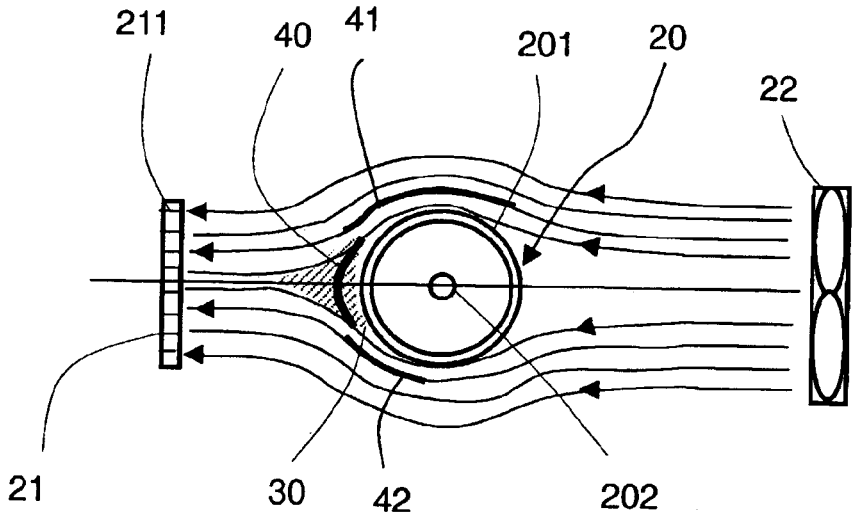
FIG. 3 is a schematic view showing the streamline of the light lamp for projector of the present invention.
Figure 4:
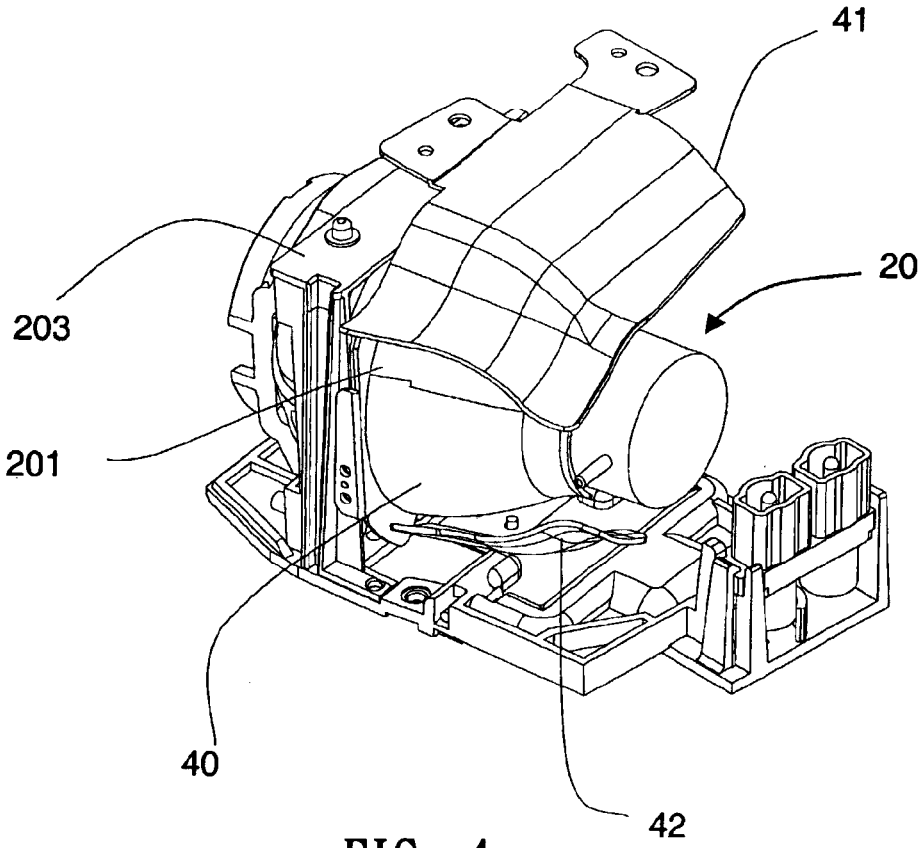
FIG. 4 is a schematic view showing the light cutter of a lamp for projector of the present invention.
Figure 5:
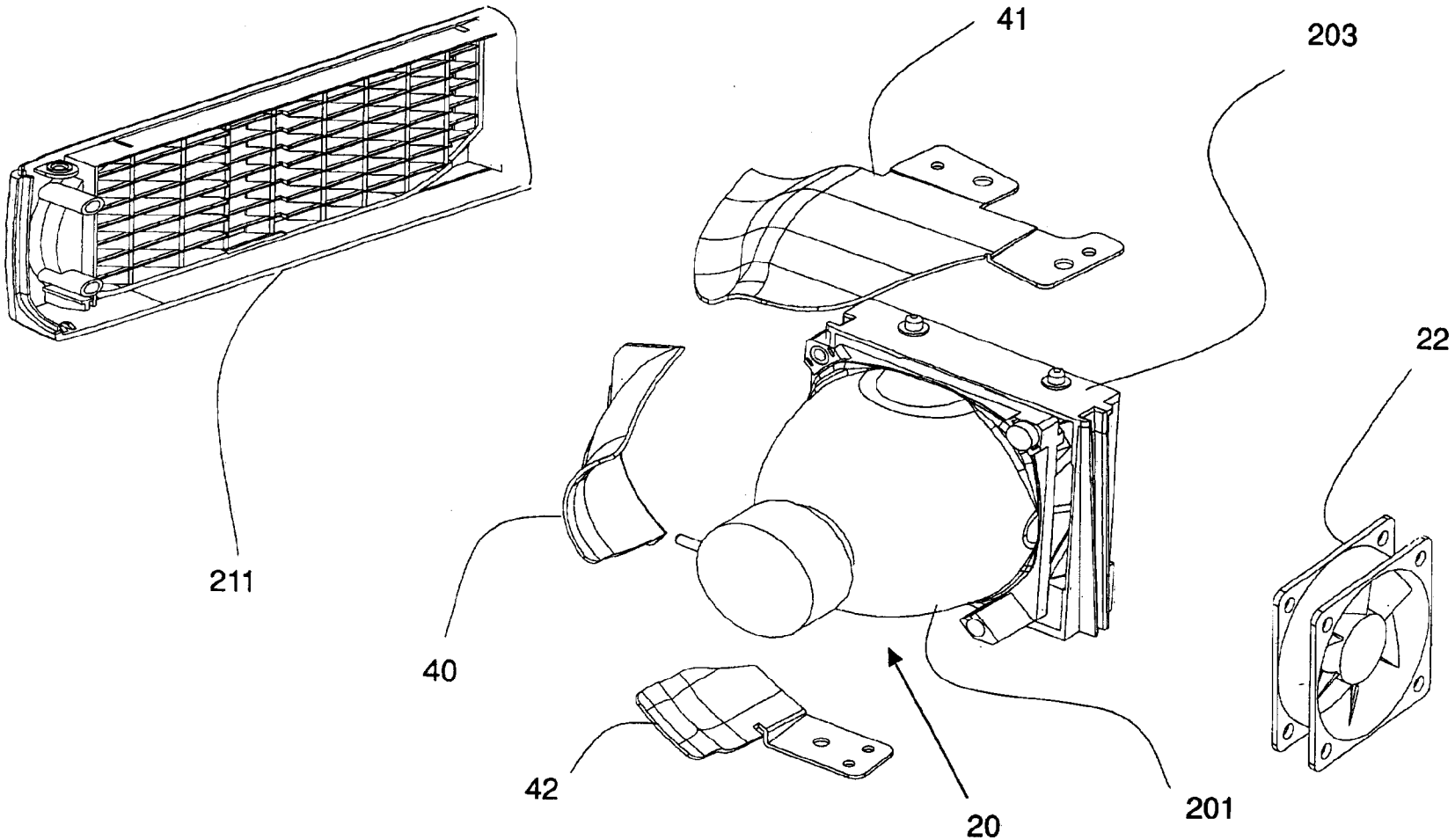
FIG. 5 is an explored view showing the light cutter of a lamp for projector of the present invention.

Referring to FIG. 3, FIG. 4 and FIG. 5, the cylinder-like or core-like lamp reflector 201 of the light lamp 20, by the streamline distribution according to the hydrodynamics, forms a wake region 30 which is shown as the oblique lines on the downstream. For almost no air flowing within the wake region 30, the influence of the light lamp 20 cooling are fewer. The present invention along the light reflector 201 within which is the wake region 30 places a front light cutter 40. The upper and lower sides of the light reflector 201 along the airflows direction are respectively placed an upper light cutter 41 and a lower light cutter 42. By means of the front light cutter 40, the upper light cutter 41, and the lower light cutter 42 that the illuminating light from a filament 202, passing through the lamp reflector 201, toward the ventilator 21 sheltered by the front light cutter 40, the upper light cutter 41, and the lower light cutter 42 and prevented leaking out of the projector. Wherein the front light cutter 40 mounted on the side surface of a light housing 203 of the light lamp 20 housing by bolts (not shown), extends along the contour of the lamp reflector 201, keeps a properly spaced apart and extends a properly distance to the back end of the lamp reflector 201 to shelter the leaking light. Wherein the upper light cutter 41 extends toward the back end of the lamp reflector 201 a keep a properly spaced, covering the lamp reflector 201, to shelter heat from the light lamp 20, prevent radiation heat conduction to the upper casing (not shown) of the projector and prevent rising the temperature of the upper casing (not shown) of the projector. The upper light cutter 41 and lower light cutter 42 housing by bolts (not shown) are mounted to the upper and lower ends of the light housing 203 of the light lamp 20, which extend along the contour of the lamp reflector 201, keep a properly spaced apart and extend a properly distance to the back end of the lamp reflector 201 to shelter the leaking light. In addition the front light cutter 40, the upper light cutter 41, and the lower light cutter respectively keep a properly spaced apart from the lamp reflector 201. By the spaced, guide the cooling airflows through the spaced to cool the light lamp 20.

In addition, the present invention has the front light cutter 40 on the wake region 30 of the downstream of the lamp reflector 201, which has no influence of the airflows produced by a fan 22, not to lower the cooling efficiency of the light lamp 20. The upper light cutter 41 and the lower light cutter 42 placed along the air streamline direction, respectively, overlap to the two ends of the front light cutter 40 to total shelter the leaking light of the light lamp 20 and keep a spaced apart from the two ends of the front light cutter 40 that not only reducing the airflows disorder but also guiding the airflows from cooling the lamp reflector 201 and, then, exhausting the heat through a guide 211. In addition, the front light cutter 40, upper light cutter 41, and lower light cutter 42 shelter the illuminating light from the filament 202. Thus, the ventilator 21 of the present invention has no need to incline the guide 211. The guide 211 of the ventilator 21 is arranged according to the streamline direction to reduce the wind resistance of the ventilator 21 and the airflows blowing by the fan 22, passing through and cooling the light lamp, exhaust out of the projector. Therefore, raising the cooling efficiency of the fan 22 and properly lower the rotational speed of fan 22 to reduce the noises of the fan22. Furthermore, reduce the radiation heat loading of the projector, lower the working temperature of each component, rise the lifetime of the components, and ensure the quality of the products. In addition the guide 211 of the ventilator 21 placed according to the streamline, not directly blowing toward the tabletop, prevents rising the temperature of table which places the projector.

Figure 6:
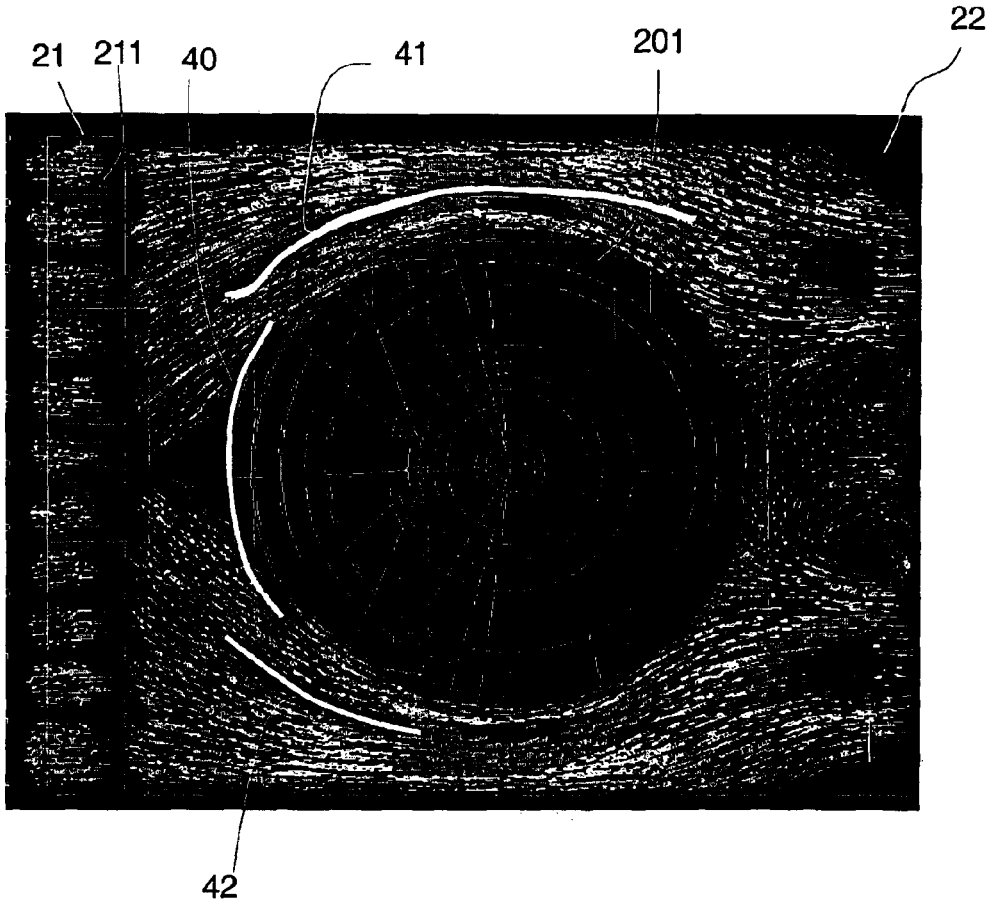
FIG. 6 is a simulation experiment view showing the streamline of the light lamp for projector of the present invention.

Referring to the FIG. 6 is the streamline simulation of the light lamp for projector of the present invention. The light lamp 20, the ventilator 21 and the fans 22 each relative position is similar to the assembly of the attached file 1. The different is the present invention adds a front light cuter 40 on the lamp reflector 201 adjacent to the guide 211, adds an upper light cutter 41 and a lower light cutter 42 respectively on the upper and lower sides of the lamp reflector 201, and arranges the guide 211 of the ventilator 21 along the air streamline. As the rotational speed of the fan 22 rising to a certain loading, the air speeds distribution of the guide 211 outlets beside the light lamp 20, the upper and lower sides without shielding by the light lamp 201, rise to the speed 4.93 m/s. But closing to the central of the side surface of the light lamp 20, the air speeds even though drop but still higher compared to the air speeds according to FIG. 2. It is apparent that the present invention is improved.

In the same logic, the present invention is described that the fan 22 and the ventilator 21 are opposite to the light lamp 20. But it is apparent to understand the fan 22, the ventilator 21, and the light lamp 20 in the same side can produce the result as the present invention.

It will be apparent to those skilled in the art that in light of the forgoing disclosure, many alternations and modifications are possible in the practice of this invention without departing from the spirit or scoop thereof. Accordingly, the scoop of the invention is to be considered in accordance with the substance defined in the following claims.

What is claimed is:

1. A light cutter of a lamp for a projector, comprising a fan which produces airflows;

a light lamp which is placed within said airflows produced by said fan;

a ventilator which is placed beside said light lamp;

at least one light cutter which is placed between said light lamp and said ventilator by means of shielding light emitting from said light lamp toward said ventilator to prevent the light from leaking out of the projector; and wherein said light lamp comprises a lamp housing and a lamp reflector, said light cutter is mounted to said lamp housing and extends along the contour of said lamp reflector toward the back side of said light lamp.

2. The light cutter of a lamp for a projector according to claim 1, wherein said light cutter is spaced apart from said lamp reflector.

3. The light cutter of a lamp for a projector according to claim 2, wherein said light cutter is a front light cutter placed within a wake region of said light lamp.

4. The light cutter of a lamp for a projector according to claim 2, wherein said light cutter is an upper light cutter placed upon an upside of said light lamp.

5. The light cutter of a lamp for a projector according to claim 4, wherein said light cutter is placed between said light lamp and an upper casing and covers said light lamp.

6. The light cutter of a lamp for a projector according to claim 2, wherein said light cutter is a lower light cutter placed below a downside of said light lamp.

7. The light cutter of a lamp for a projector according to claim 2, wherein said light cutter comprises a front light cutter, an upper light cutter, and a lower light cutter, the upper light cutter and the lower light cutter are spaced apart and overlap portions of the front light cutter.

* * * * *